US011222576B2

(12) United States Patent
Pyun et al.

(10) Patent No.: US 11,222,576 B2
(45) Date of Patent: Jan. 11, 2022

(54) DISPLAY DEVICE AND METHOD FOR DRIVING THE SAME

(71) Applicant: Samsung Display Co., Ltd., Yongin-Si (KR)

(72) Inventors: Ki Hyun Pyun, Yongin-si (KR); Eun Jin Choi, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/920,795

(22) Filed: Jul. 6, 2020

(65) Prior Publication Data

US 2021/0150971 A1 May 20, 2021

(30) Foreign Application Priority Data

Nov. 18, 2019 (KR) ..... 10-2019-0147337

(51) Int. Cl.
*G09G 3/20* (2006.01)

(52) U.S. Cl.
CPC ... *G09G 3/2092* (2013.01); *G09G 2310/0275* (2013.01); *G09G 2320/0276* (2013.01); *G09G 2320/0673* (2013.01); *G09G 2330/021* (2013.01)

(58) Field of Classification Search
CPC ..... G09G 2320/0295; G09G 3/3233; G09G 2320/0693; G09G 2310/027; G09G 2320/0233; G09G 2320/045; G09G 2320/0271; G09G 2320/041; G09G 2300/043
See application file for complete search history.

(56) References Cited

U.S. PATENT DOCUMENTS

| | | | | |
|---|---|---|---|---|
| 2006/0097969 | A1 | 5/2006 | Tsai et al. | |
| 2011/0216056 | A1* | 9/2011 | Yoo | G09G 3/3233 345/212 |
| 2018/0158397 | A1* | 6/2018 | Nam | G09G 3/2096 |
| 2019/0139490 | A1 | 5/2019 | Bang et al. | |
| 2019/0141271 | A1 | 5/2019 | Kang et al. | |
| 2021/0012705 | A1 | 1/2021 | Pyun et al. | |

FOREIGN PATENT DOCUMENTS

| | | | |
|---|---|---|---|
| KR | 10-2016-0042269 | A | 4/2016 |
| KR | 10-2017-0131804 | A | 11/2017 |
| KR | 10-2021-0008199 | A | 1/2021 |

* cited by examiner

*Primary Examiner* — Gerald Johnson
(74) *Attorney, Agent, or Firm* — Innovation Counsel LLP

(57) ABSTRACT

A display device and a method for driving the same are described. The display device includes a plurality of pixels, a driving characteristic compensator for sensing driving characteristics of the pixels, generating first power source voltage information according to a change in the driving characteristics, and updating an RGB gamma look up table, a memory for storing the first power source voltage information and the RGB gamma look-up table, a power source manager for generating a first power source voltage based on the first power source voltage information, and a gamma controller for generating reference gamma voltages by dividing the first power source voltage supplied from the power source manager based on the RGB gamma look-up table. Therefore, power consumption of the display device may be reduced.

18 Claims, 10 Drawing Sheets

DISPLAY DEVICE AND METHOD FOR DRIVING THE SAME

CROSS-REFERENCE TO RELATED APPLICATION

The application claims priority to and the benefit of Korean Patent Application No. 10-2019-0147337, filed Nov. 18, 2019, which is hereby incorporated by reference for all purposes as if fully set forth herein.

BACKGROUND

Field

Embodiments of the present inventive concept relate to a display device, and more particularly, to a display device and a method for driving the same.

Related Art

With a development of information technology, importance of display devices, which are a connection medium between users and information, has been emphasized. In response to this, the use of display devices such as a liquid crystal display device, an organic light emitting display device, and a plasma display device has been increasing.

In a display device, each pixel may emit light with luminance corresponding to a data voltage supplied through a data line. The display device may display an image frame by combining light emitted from pixels.

Each pixel of the display device includes a light emitting element that emits light according to the amount of current flowing through the light emitting element, and a driving transistor that controls the current flowing through the light emitting element. Electrical characteristics of the driving transistor, for example, a threshold voltage, mobility, and the like, may be changed. In addition, even when the same amount of current is supplied to the light emitting element, the luminance of light emitted from the light emitting element may vary.

The display device receives a voltage for generating a data voltage required for each pixel from a power source manager. In general, a fixed value having a margin sufficient to cover the use range of the data voltage is used for the voltage supplied from the power source manager.

SUMMARY

An object of the present inventive concept is to provide a display device that dynamically applies a data voltage margin according to a change in driving characteristics of a driving transistor and a light emitting element included in a pixel.

Another object of the present inventive concept is to provide a method of driving the display device that updates a first power source voltage and an RGB gamma look-up table according to a dynamic change in the data voltage margin.

One aspect of the present inventive concept for achieving the above object provides a display device.

The display device may include a plurality of pixels; a driving characteristic compensator connected to the plurality of pixels through a plurality of receiving lines, the driving characteristic compensator sensing driving characteristics of the plurality of pixels, generating first power source voltage information according to a change in the driving characteristics, and updating an RGB gamma look-up table; a memory connected to the driving characteristic compensator, the memory storing the first power source voltage information and the RGB gamma look-up table; a power source manager connected to the memory, the power source manager generating a first power source voltage based on the first power source voltage information; and a gamma controller connected between the power source manager and a data driver, the gamma controller generating reference gamma voltages by dividing the first power source voltage supplied from the power source manager based on the RGB gamma look-up table.

The driving characteristic compensator may include a driving characteristic sensor connected to the plurality of receiving lines, the driving characteristic sensor sensing the driving characteristics based on currents sensed from the plurality of pixels; a driving characteristic change calculator connected to the driving characteristic sensor, the driving characteristic change calculator calculating a change amount of the drive characteristics; a data voltage margin generator connected to the driving characteristic change calculator, the data voltage margin generator receiving the change amount of the driving characteristics and generating a data voltage margin using the change amount of the driving characteristics; and a first power source voltage information generator connected to the data voltage margin generator, the first power source voltage information generator generating the first power source voltage information based on the data voltage margin.

The driving characteristics may include mobility and threshold voltage of a driving transistor in each of the plurality of pixels, and deterioration information of a light emitting element.

The deterioration information of the light emitting element may include an anode voltage applied to an anode of the light emitting element.

The data voltage margin generator may generate a first voltage for compensating for a change amount of the threshold voltage, a second voltage for compensating for a change amount of the mobility, and a third voltage for compensating for a change amount of the anode voltage.

The first voltage may have the same magnitude as the change amount of the threshold voltage and have a sign opposite to a sign according to the change amount of the threshold voltage.

The second voltage may be a voltage of the driving transistor that is additionally required to compensate for a decrease amount in current of the driving transistor that is reduced according to the change amount of the mobility.

The third voltage may have the same magnitude as the change amount of the anode voltage and have a sign opposite to a sign according to the change amount of the anode voltage.

The data voltage margin generator may generate the data voltage margin to have a value greater than or equal to the sum of the first voltage, the second voltage, and the third voltage.

The first power source voltage information generator may generate the first power source voltage information which indicates the first power source voltage, the first power source voltage information being set for a first power source voltage to have a value greater than or equal to the sum of the data voltage margin and an essential data voltage.

The driving characteristic compensator may further include a look-up table updater connected to the first power source voltage information generator, the look-up table updater updating the RGB gamma look-up table by mapping data voltages and grayscale values to correspond to each other within the sum of the essential data voltage and the data voltage margin.

The data driver for supplying data voltages generated using the reference gamma voltages to the plurality of pixels.

Another aspect of the present inventive concept for achieving the above object provides a method of driving a display device.

The method for driving the display device may include sensing driving characteristics of pixels included in the display device; generating first power source voltage information according to a change in the driving characteristics; storing the first power source voltage information in a memory; updating an RGB gamma look-up table previously stored in the memory; generating a first power source voltage based on the first power source voltage information; and generating reference gamma voltages by dividing the first power source voltage based on the updated RGB gamma look-up table.

The updating the RGB gamma look-up table may include generating a data voltage margin using a change amount of the driving characteristics; and generating the first power source voltage information based on the data voltage margin.

The driving characteristics may include mobility and threshold voltage of a driving transistor in each of the pixels, and deterioration information of a light emitting element.

The deterioration information of the light emitting element may include an anode voltage applied to an anode of the light emitting element.

In the generating the data voltage margin, a first voltage for compensating for a change amount of the threshold voltage, a second voltage for compensating for a change amount of the mobility, and a third voltage for compensating for a change amount of the anode voltage may be generated.

The first voltage may have the same magnitude as the change amount of the threshold voltage and have a sign opposite to a sign according to the change amount of the threshold voltage.

In the generating the data voltage margin, the data voltage margin is set to have a value greater than or equal to the sum of the first voltage, the second voltage, and the third voltage.

The generating the first power source voltage information based on the data voltage margin may include generating the first power source voltage to have a value greater than or equal to the sum of the data voltage margin and an essential data voltage; and generating the first power source voltage information indicating the first power source voltage.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
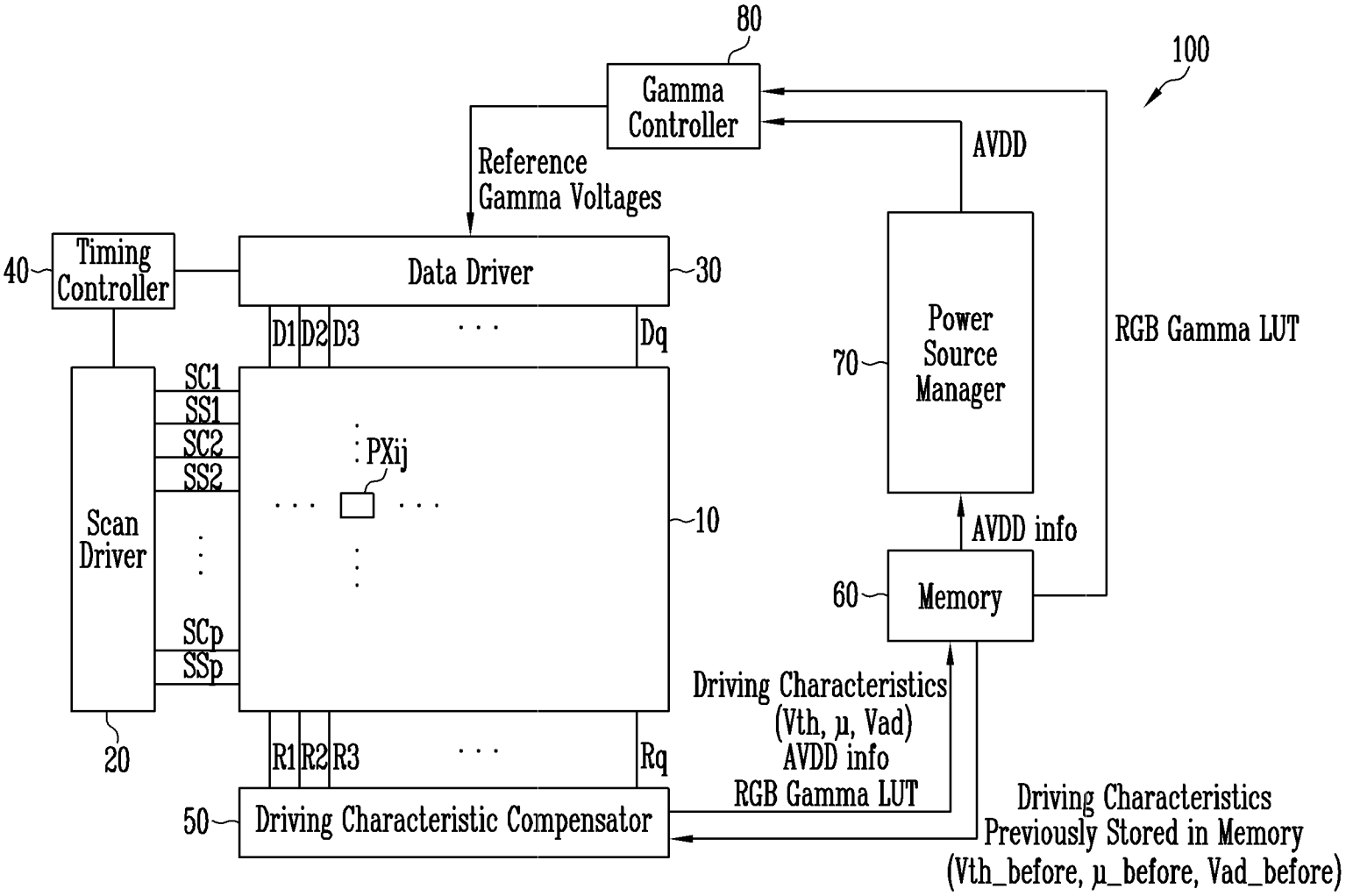
FIG. 1 is a block diagram for explaining a display device according to an embodiment of the present inventive concept.

Like reference numerals refer to like elements. In addition, in the drawings, the thicknesses, proportions, and dimensions of elements are exaggerated to effectively explain the technical content. The term "and/or" includes one or more combinations in which associated configurations may be defined.

The terms "first", "second", etc. may be used to describe various elements, but the elements should not be limited by these terms. These terms are used only for the purpose of distinguishing one element from another element. For example, a first element may be referred to as a second element, and similarly the second element may be referred to as the first element without departing from the scope of the present inventive concept. Singular expressions may include plural expressions unless the context clearly indicates otherwise.

In addition, the terms "below", "under", "above", "upper", etc. may be used to describe the association of the elements shown in the drawings. The terms are relative concepts and are explained based on the shapes and directions indicated in the drawings.

The terms "including", "having", etc. are intended to designate features, numbers, steps, operations, elements, components, or combinations thereof described in the disclosure. It should be understood that it does not exclude in advance the possibility of the presence or addition of one or more other features, numbers, steps, operations, elements, components, or combinations thereof.

Hereinafter, exemplary embodiments of the present inventive concept will be described in detail with reference to the accompanying drawings so that those skilled in the art can easily carry out the present inventive concept. The present inventive concept may be embodied in various forms and is not limited to the embodiments described herein.

FIG. 1 is a block diagram for explaining a display device according to an embodiment of the present inventive concept.

Referring to FIG. 1, a display device 100 according to an embodiment of the present inventive concept may include a pixel area 10, a scan driver 20, a data driver 30, a timing controller 40, a driving characteristic compensator 50, a memory 60, a power source manager 70, and a gamma controller 80.

The pixel area 10 may include a plurality of pixels. Each pixel PXij may be connected to a corresponding data line Dj, a corresponding first scan line SCi, a corresponding second scan line SSi, and a corresponding receiving line Rj, where i and j may be integers greater than zero. For example, the pixel PXij may refer to a pixel circuit in which a scan transistor is connected to an i-th first scan line and a j-th data line. For example, the pixel area 10 may include a first sub-pixel, a second sub-pixel, and a third sub-pixel. The first sub-pixel may emit red light, the second sub-pixel may emit green light, and the third sub-pixel may emit blue light.

The scan driver 20 may receive a clock signal, a control signal, and the like from the timing controller 40 to generate scan signals to be provided to first scan lines SC1, SC2, . . . , and SCp. For example, the scan driver 20 may sequentially provide first scan signals having a turn-on level pulse to the first scan lines SC1, SC2, . . . , and SCp. For example, the scan driver 20 may generate the first scan signals by sequentially transferring a carry signal having a turn-on level pulse to the next stage according to the clock signal, and provide the first scan signals to the first scan lines SC1, SC2, . . . , and SCp. In addition, the scan driver 20 may sequentially provide second scan signals having the turn-on level pulse to second scan lines SS1, SS2, . . . , and SSp. For example, the scan driver 20 may generate the second scan signals by sequentially transferring the carry signal having the turn-on level pulse to the next stage according to the clock signal, and provide the second scan signals to the second scan lines SS1, SS2, . . . , and SSp, where p may be an integer greater than zero. For example, the scan driver 20 may be implemented as a shift register.

The data driver 30 may generate data voltages to be provided to data lines D1, D2, D3, . . . , and Dq using grayscale values, a control signal, and the like received from the timing controller 40. For example, the data driver 30 may sample the grayscale values using a clock signal, and apply the data voltages corresponding to the grayscale values to the data lines D1, D2, D3, . . . , and Dq one pixel row at a time (for example, pixels connected to the same scan line), where q may be an integer greater than zero. In this case, the data driver 30 may generate the data voltages corresponding to the grayscale values with reference to reference gamma voltages supplied from the gamma controller 80.

The timing controller 40 may provide the data driver 30 with the grayscale values, the control signal, and the like, for each frame in an image. In addition, the timing controller 40 may provide a clock signal, a control signal, and the like to each of the scan driver 20 and the driving characteristic compensator 50.

The driving characteristic compensator 50 may sense driving characteristics of each pixel PXij included in the pixel area 10 through a respective receiving lines R1, R2, R3, . . . , and Rq. The driving characteristic compensator 50 may receive currents or voltages through receiving lines R1, R2, R3, . . . , and Rq to sense driving characteristics of pixels Pxij. For example, the driving characteristics of each pixel PXij may include mobility μ and threshold voltage Vth of a driving transistor, and information (for example, anode voltage Vad) of a light emitting element. In addition, the driving characteristic compensator 50 may continuously store the sensed driving characteristics in the memory 60. In addition, the driving characteristic compensator 50 may generate first power source voltage information AVDD info which are basic data used by the power source manager 70 to generate a first power source voltage AVDD and an RGB gamma look-up table RGB gamma LUT using the driving characteristics, and store the first power source voltage information AVDD info and the RGB gamma look-up table RGB gamma LUT in the memory 60. The RGB gamma look-up table RGB gamma LUT may be data obtained by mapping the data voltages corresponding to the grayscale values in digital code form with respect to each pixel included in the pixel area 10 (or each of the first sub-pixel, the second sub-pixel, and the third sub-pixel included in each pixel).

The memory 60 may receive and store the driving characteristics, the first power source voltage information AVDD info, the RGB gamma look-up table RGB gamma LUT, and the like through the driving characteristic compensator 50. In addition, the driving characteristic compensator 50 may receive the driving characteristics stored in the memory 60.

The power source manager 70 may supply various power source voltages required by the gamma controller 80 or the pixels in the pixel area 10. For example, the power source manager 70 may supply a first driving voltage ELVDD (see FIG. 2) and a second driving voltage ELVSS (see FIG. 2) required for an operation of the pixels in the pixel area 10. In addition, the power source manager 70 may generate the first power source voltage AVDD with reference to the first power source voltage information AVDD info obtained from the memory 60, and supply the first power source voltage AVDD to the gamma controller 80.

The gamma controller 80 may receive the first power source voltage AVDD supplied from the power source manager 70, generate the reference gamma voltages from the first power source voltage AVDD with reference to the RGB gamma look-up table RGB gamma LUT obtained from the memory 60, and supply the reference gamma voltages to the data driver 30. For example, the gamma controller 80 may generate the reference gamma voltages by dividing the first power source voltage AVDD using a mapping between the data voltages and the grayscale values confirmed by the RGB gamma look-up table RGB gamma LUT. The reference gamma voltages may be a reference value used by the data driver 30 to generate the data voltages to be supplied to the data lines D1, D2, . . . , and Dq in response to the grayscale values received from the timing controller 40. The reference gamma voltages may correspond to specific grayscale values, respectively. The data driver 30 may generate the data voltages for the remaining grayscale values other than the specific grayscale values corresponding to the reference gamma voltages by interpolating the reference gamma voltages.

Figure 2:
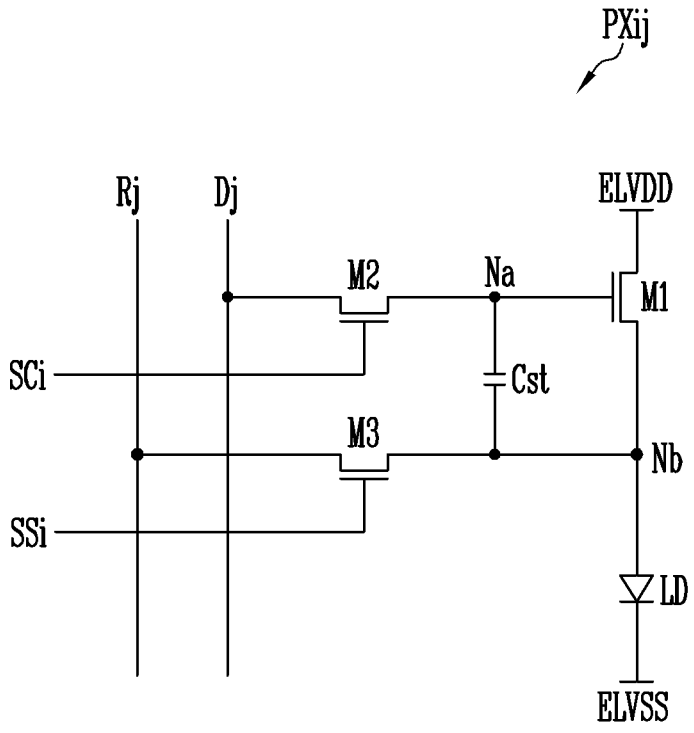
FIG. 2 is a circuit diagram exemplarily illustrating each pixel in a pixel area according to an embodiment of the present inventive concept.

FIG. 2 is a circuit diagram exemplarily illustrating each pixel in a pixel area according to an embodiment of the present inventive concept.

The pixel PXij may include transistors M1, M2, and M3, a storage capacitor Cst, and a light emitting element LD.

The transistors M1, M2, and M3 may be N-type transistors. In another embodiment, the transistors M1, M2, and M3 may be P-type transistors. In another embodiment, the transistors M1, M2, and M3 may be composed of a combination of an N-type transistor and a P-type transistor. The P-type transistor generally means a transistor that is turned on when a voltage difference between a gate electrode and a source electrode increases in a negative direction, and thus the amount of current increases. The N-type transistor generally means a transistor that is turned on when the voltage difference between the gate electrode and the source electrode increases in a positive direction, and thus the amount of current increases. The transistors M1, M2, and M3 may be configured in various forms such as a thin film transistor (TFT), a field effect transistor (FET), and a bipolar junction transistor (BJT).

The first transistor M1 may include a gate electrode connected to a first node Na, a first electrode connected to a wiring supplied with the first driving voltage ELVDD, and a second electrode connected to a second node Nb. The first transistor M1 may be referred to as a driving transistor throughout the present disclosure.

The second transistor M2 may include a gate electrode connected to the first scan line SCi, a first electrode connected to the data line Dj, and a second electrode connected to the first node Na. The second transistor M2 may be referred to as a scan transistor.

The third transistor M3 may include a gate electrode connected to the second scan line SSi, a first electrode connected to the second node Nb, and a second electrode connected to the receiving line Rj. The third transistor M3 may be referred to as a sensing transistor.

The storage capacitor Cst may include a first electrode connected to the first node Na and a second electrode connected to the second node Nb.

The light emitting element LD may include an anode connected to the second node Nb and a cathode connected to a wiring supplied with the second driving voltage ELVSS.

In general, the first driving voltage ELVDD may be greater than the second driving voltage ELVSS. However, in a specific situation such as to prevent light emission of the light emitting element LD, the second driving voltage ELVSS may be set larger than the first driving voltage ELVDD.

When the second transistor M2 and the third transistor M3 are turned on by a first scan signal of the first scan line SCi and a second scan signal of the second scan line Ssi while applying a corresponding data voltage to the data line Dj and a first reference voltage to the receiving line Rj, the storage capacitor Cst may store a voltage difference between the data voltage and the first reference voltage. Thereafter, even when the second and third transistors M2 and M3 are turned off, the voltage stored in the storage capacitor Cst may be maintained. The amount of driving current flowing through the first transistor M1 may be determined according to the voltage stored in the storage capacitor Cst, and the light emitting element LD may emit light with luminance corresponding to the amount of the driving current.

Meanwhile, the driving characteristic compensator 50 of the display device 100 shown in FIG. 1 may sense the driving characteristics of the pixels by using the voltage and current of the receiving line Rj. As described with reference to FIG. 1, the driving characteristics may include the mobility μ and threshold voltage Vth of the driving transistor, and the deterioration information EL of the light emitting element.

For example, the mobility μ and threshold voltage Vth of the first transistor M1 (or the driving transistor) may be sensed based on the voltage and current of the data line Dj and/or the receiving line Rj. In addition, the deterioration information of the light emitting element LD may be sensed based on an anode voltage applied to the anode of the light emitting element LD (or a voltage applied to the second node Nb).

Hereinafter, an operation of the driving characteristic compensator 50 that detects such driving characteristic and dynamically changes the first power source voltage AVDD and the RGB gamma look-up table in order to reduce power consumption will be described in detail.

Figure 3:
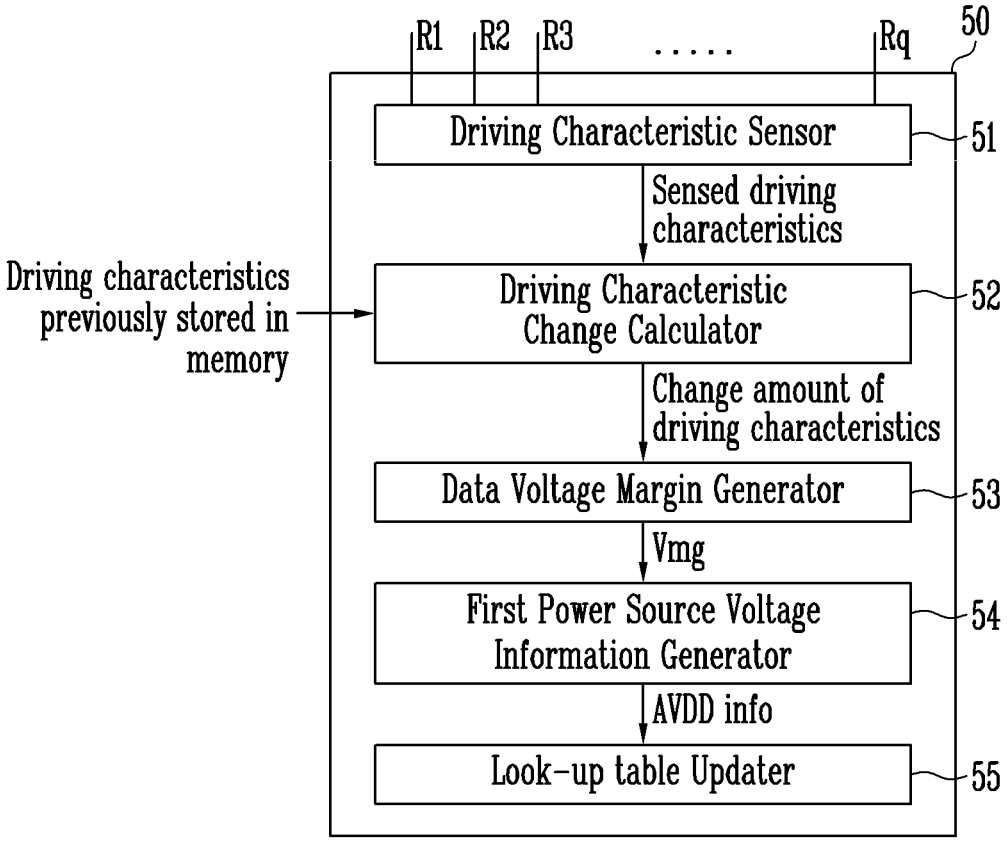
FIG. 3 is a block diagram of a driving characteristic compensator according to an embodiment of the present inventive concept.
Figure 4:
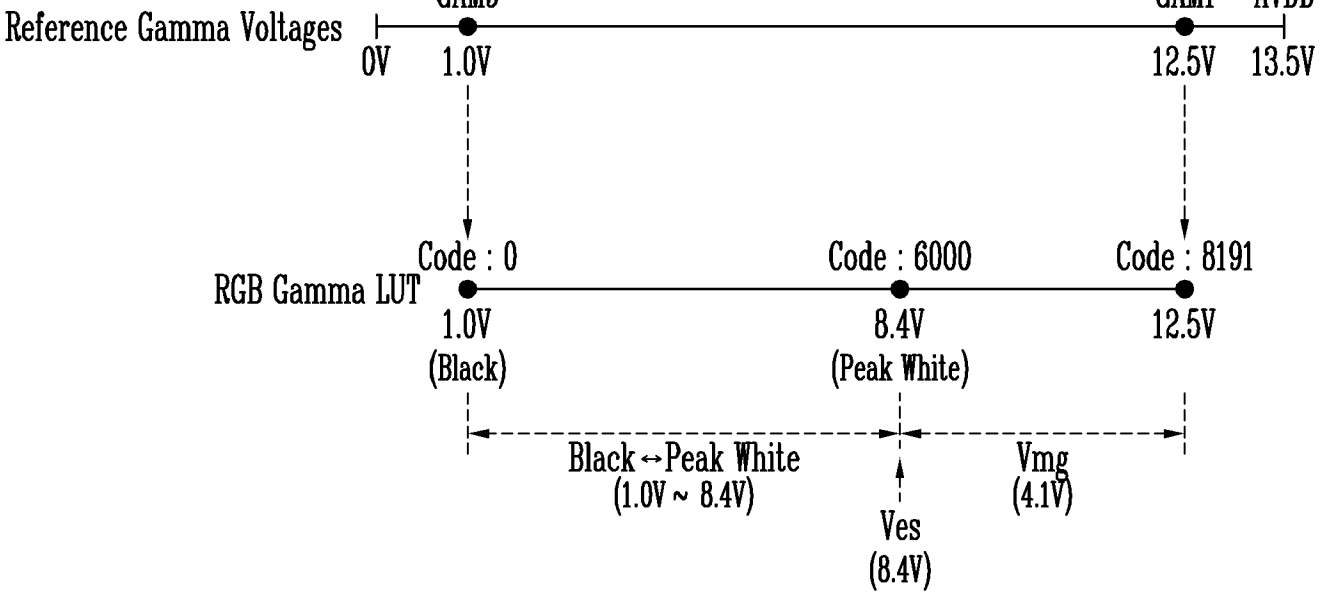
FIG. 4 is a first conceptual diagram for explaining a relationship between an essential data voltage, a data voltage margin, and an RGB gamma look-up table according to an embodiment of the present inventive concept.
Figure 5:
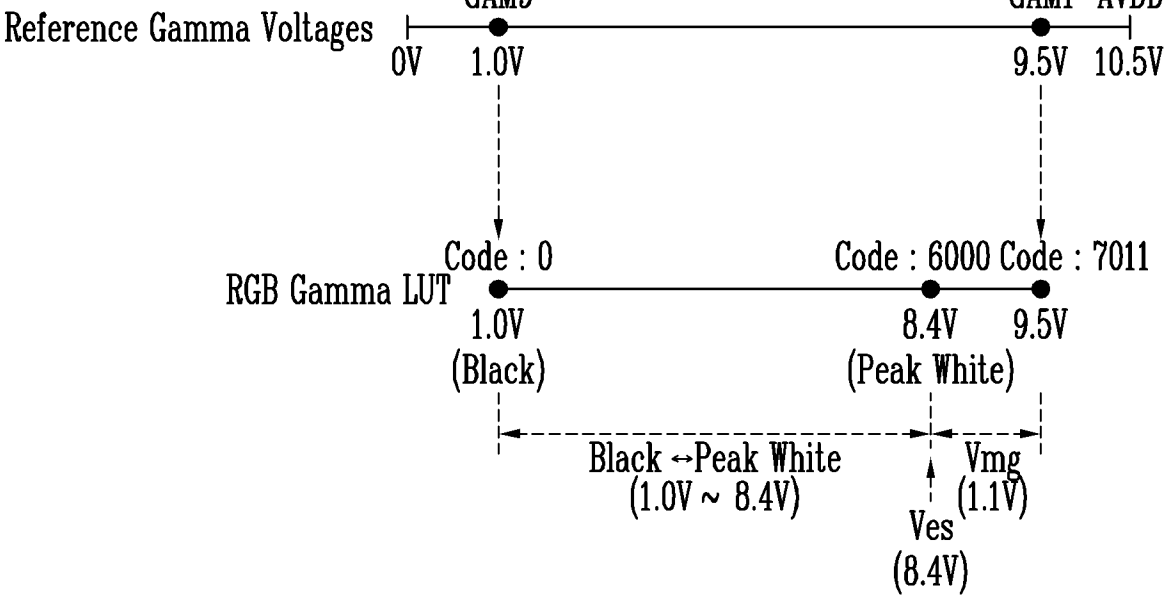
FIG. 5 is a second conceptual diagram for explaining a relationship between an essential data voltage, a data voltage margin, and an RGB gamma look-up table according to an embodiment of the present inventive concept.

FIG. 3 is a block diagram of a driving characteristic compensator according to an embodiment of the present inventive concept. FIG. 4 is a first conceptual diagram for explaining a relationship between an essential data voltage, a data voltage margin, and an RGB gamma look-up table according to an embodiment of the present inventive concept. FIG. 5 is a second conceptual diagram for explaining a relationship between an essential data voltage, a data voltage margin, and an RGB gamma look-up table according to an embodiment of the present inventive concept.

Referring to FIGS. 1 and 3, the driving characteristic compensator 50 may include a driving characteristic sensor 51, a driving characteristic change calculator 52, a data voltage margin generator 53, and/or a first power source voltage information generator 54.

The driving characteristic sensor 51 may sense the driving characteristics of each pixel through receiving lines R1, R2, R3, . . . , and Rq. For example, the driving characteristic sensor 51 may sense the mobility μ and threshold voltage Vth of the driving transistor and the deterioration information of the light emitting element LD for each pixel through receiving lines R1, R2, R3, . . . , and Rq. The deterioration information of the light emitting element LD may include the anode voltage applied to the anode of the light emitting element LD (or the voltage applied to the second node Nb, see FIG. 2).

The driving characteristic change calculator 52 may calculate a change amount of the driving characteristics sensed by the driving characteristic sensor 51. For example, the driving characteristic change calculator 52 may calculate a change amount of the threshold voltage by comparing the threshold voltage Vth sensed by the driving characteristic sensor 51 with a threshold voltage Vth_before which was sensed and stored in the memory 60, for example, one of threshold voltages for previous frames. In addition, the driving characteristic change calculator 52 may calculate a change amount of the mobility by comparing the mobility μ sensed by the driving characteristic sensor 51 with mobility μ_before which was sensed and stored in the memory 60, for example, one of threshold voltages for previous frames. In addition, the driving characteristic change calculator 52 may calculate a change amount of the anode voltage by comparing (or differentiating) the anode voltage Vad sensed by the driving characteristic sensor 51 with an anode voltage Vad_before which was sensed and stored in the memory 60. In this case, the threshold voltage Vth_before, the mobility μ_before, and the anode voltage Vad_before obtained from the memory 60 may be the driving characteristics previously sensed by the driving characteristic sensor 51 and stored in the memory 60.

The data voltage margin generator 53 may calculate a data voltage margin by using the change amount of the driving characteristics received from the driving characteristic change calculator 52. The data voltage margin generator 53 may calculate a first voltage for compensating for the change amount of the threshold voltage Vth. The data voltage margin generator 53 may calculate a second voltage for compensating for the change amount of the mobility μ. In addition, the data voltage margin generator 53 may calculate a third voltage for compensating for the change amount of the anode voltage Vad. The data voltage margin generator 53 may calculate the data voltage margin Vmg that is greater than or equal to the sum of the first voltage Vth_offset, the second voltage Vgs_offset, and the third voltage Vad_offset.

The data voltage margin Vmg may be an extra data voltage for compensating for a change in luminance due to a change in the driving characteristics in addition to the essential data voltage Ves which is essentially used to express the grayscale values in each pixel.

For example, referring to FIG. 4, the data voltage of a black grayscale that requires the lowest data voltage may be 1 V, and the data voltage of a peak white grayscale that requires the highest data voltage may be 8.4 V. The essential data voltage Ves may be the largest data voltage among the data voltages according to all grayscale values.

In FIG. 4, the maximum data voltage margin Vmg that can be added to the essential data voltage Ves may have a fixed value, for example, 4.1 V. In addition, the first power source voltage AVDD may have a value larger by a predetermined value (for example, 1 V) than the sum of the essential data voltage Ves and the maximum data voltage margin (4.1 V). As such, when the fixed data voltage margin Vmg is used, an unnecessarily high first power source voltage AVDD may be used in initial driving of the display device 100. Therefore, the reference gamma voltages GAM1 to GAMS which is used to generating the data voltage also become high level voltages. Accordingly, power consumption may be increased unnecessarily.

Unlike FIG. 4, according to an embodiment of the present inventive concept, the data voltage margin Vmg may be dynamically determined according to Equation 1 below.

$$Vmg \geq Vth_offset + Vgs_offset + Vad_offset \quad \text{[Equation 1]}$$

In Equation 1, Vmg may be the data voltage margin, Vth_offset may be the first voltage, Vgs_offset may be the second voltage, and Vad_offset may be the third voltage. That is, the data voltage margin Vmg may be greater than or equal to a sum of the first voltage Vth_offset, the second voltage Vgs_offset, and the third voltage Vad_offset. In a more detailed example, the data voltage margin Vmg may be greater than or equal to the sum of the first voltage Vth_offset, the second voltage Vgs_offset, the third voltage Vad_offset, and a voltage for correcting a spot. The voltage for correcting the spot may be a data voltage additionally applied to the pixels in a spot area in order to correct the spot of various patterns that may be generated by the pixels of the display device.

According to an embodiment of the present inventive concept, as shown in Equation 1, the data voltage margin Vmg may be dynamically determined by using the first voltage Vth_offset, the second voltage Vgs_offset, and the third voltage Vad_offset which indicate the change in driving characteristics dynamically sensed by the driving characteristic change calculator 52. For example, referring to FIG. 5, in the initial driving of the display device 100, since deterioration of driving characteristics of the driving transistor and the light emitting element is small, the data voltage margin Vmg according to Equation 1 may be determined as 1.1 V. Therefore, since 10.5 V obtained by adding the predetermined value (for example, 1.0 V) to the sum of the essential data voltage Ves and the data voltage margin Vmg can be used as the first power source voltage AVDD, a voltage having lower level than the first power source voltage AVDD according to FIG. 4 may be used.

The first power source voltage information generator 54 may generate the first power source voltage information AVDD info based on the data voltage margin Vmg received from the data voltage margin generator 53. More specifically, the first power source voltage information generator 54 may determine the first power source voltage AVDD to have a value greater than or equal to the sum of the data voltage margin Vmg and the essential data voltage Ves, and generate the first power source voltage information AVDD info indicating the determined first power source voltage AVDD. For example, the first power source voltage AVDD may be determined by adding the data voltage margin Vmg, the essential data voltage Ves, and the predetermined value (voltage). Here, the predetermined voltage is a voltage value initially input by a user, and a voltage value selected in consideration of power consumption may be used. For example, the predetermined voltage may be a voltage selected between 0 and 1 (V). In this case, the generated first power source voltage information AVDD info may be stored in the memory 60 shown in FIG. 1.

In summary, in an embodiment of the present inventive concept, since the first power source voltage AVDD is dynamically determined according to the calculated data voltage margin Vmg, the power consumption of the display device 100 may be reduced than when the fixed large data voltage margin Vmg is used. In addition, the first power source voltage AVDD determined here may be used by the gamma controller 80 according to FIG. 1 to generate the reference gamma voltages. For example, the reference gamma voltages may be generated by dividing the first power source voltage AVDD. In FIG. 4, the smallest gamma voltage among nine reference gamma voltages (for example, GAM1 to GAM9) is shown as a ninth gamma voltage GAM9, and the largest gamma voltage among the nine reference gamma voltages is shown as a first gamma voltage GAM1. However, the number and value of the reference gamma voltages may be determined differently.

Meanwhile, the driving characteristic compensator 50 may further include a look-up table updater 55. The RGB gamma look-up table RGB Gamma LUT may be updated as the data voltage margin Vmg changes and used to compensate for the change in driving characteristics. For example, the look-up table updater 55 may map the data voltages (1.0 V to 12.5 V in FIG. 4) and the grayscale values to correspond to each other within the sum of the essential data voltage Vss and the data voltage margin Vmg. As a result, the RGB gamma look-up table RGB Gamma LUT stored in the memory 60 may be updated. In this case, the RGB gamma look-up table RGB Gamma LUT may include a digital signal Coad indicating the mapped data voltages. Here, the updated RGB gamma look-up table RGB gamma LUT may be stored in the memory 60 shown in FIG. 1.

Figure 6:
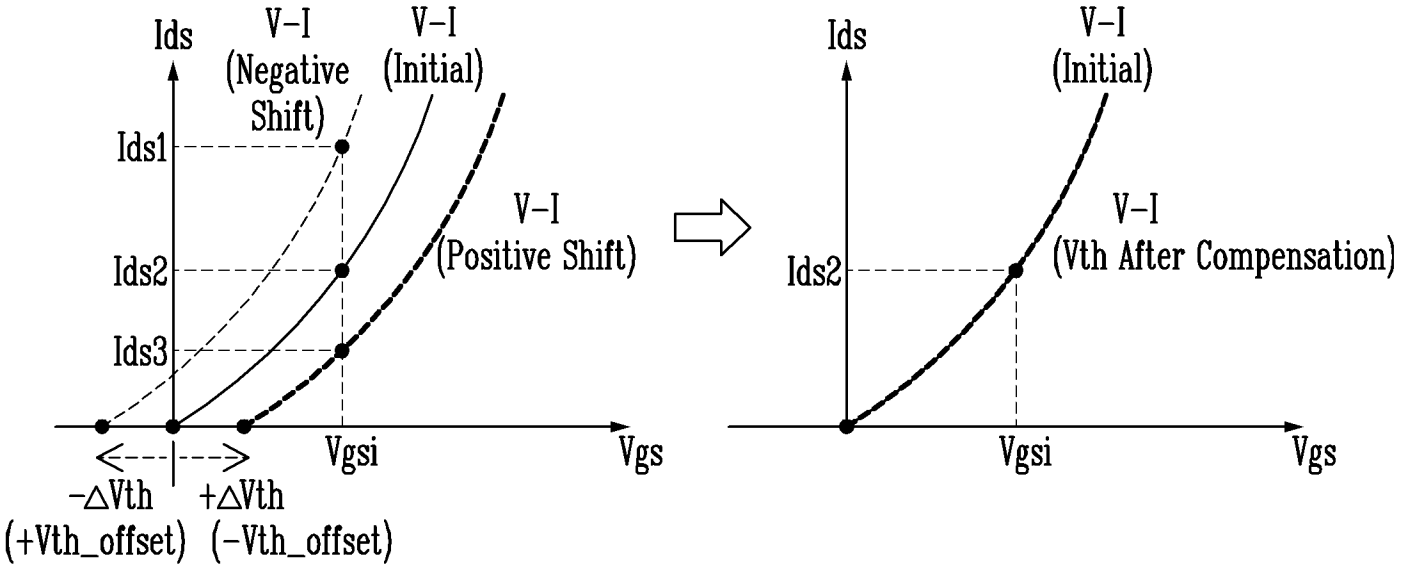
FIG. 6 is a graph for explaining a change in threshold voltage of a driving transistor according to an embodiment of the present inventive concept.

FIG. 6 is a graph for explaining a change in threshold voltage of a driving transistor according to an embodiment of the present inventive concept.

Referring to FIGS. 3 and 6, initial characteristic V-I (Initial) of the driving transistor M1 and current characteristic V-I (Positive Shift) or V-I (Negative Shift) sensed by the driving characteristic sensor 51 are shown in the graph. In this case, the initial characteristic V-I (Initial) of the driving transistor M1 may be stored in the memory 60 in advance.

Referring to the graph on the left side of FIG. 6, the driving characteristic sensor 51 may sense a voltage (or a voltage between a gate electrode and a source electrode, Vgs) of the driving transistor M1 as the threshold voltage Vth when a current (or a current between a drain electrode and the source electrode, Ids) starts to flow in the driving transistor M1.

In this case, the change amount of the threshold voltage Vth may be a positive value +ΔVth or a negative value −ΔVth. In a case where the change amount of the threshold voltage Vth is the positive value +ΔVth, when the same voltage Vgsi is applied, a current Ids3 of the driving transistor M1 is decreased in comparison with the initial characteristic V-I (Initial). Therefore, a decrease in luminance due to a decrease in current is expected, and therefore an increase in data voltage is required to maintain the same luminance as the initial characteristic. In addition, in a case where the change amount of the threshold voltage Vth is the negative value −ΔVth, when the same voltage Vgsi is applied, a current Ids1 of the driving transistor M1 is increased in comparison with the initial characteristic V-I (Initial). Therefore, an increase in luminance due to an increase in current is expected, and therefore a decrease in data voltage is required to maintain the same luminance as the initial characteristic.

Therefore, the first voltage Vth_offset for compensating for the change amount of the threshold voltage Vth may have the same magnitude and the opposite sign as the change amount of the threshold voltage Vth.

As such, when the first voltage Vth_offset for compensating for the change amount of the threshold voltage Vth is generated and added to the essential data voltage Ves as the data voltage margin Vmg, the change amount of the threshold voltage is compensated for, so that the initial characteristic of the driving transistor can be maintained as shown in the graph on the right side of FIG. 5 even when the threshold voltage shift Vth shift is occurred.

Figure 7:
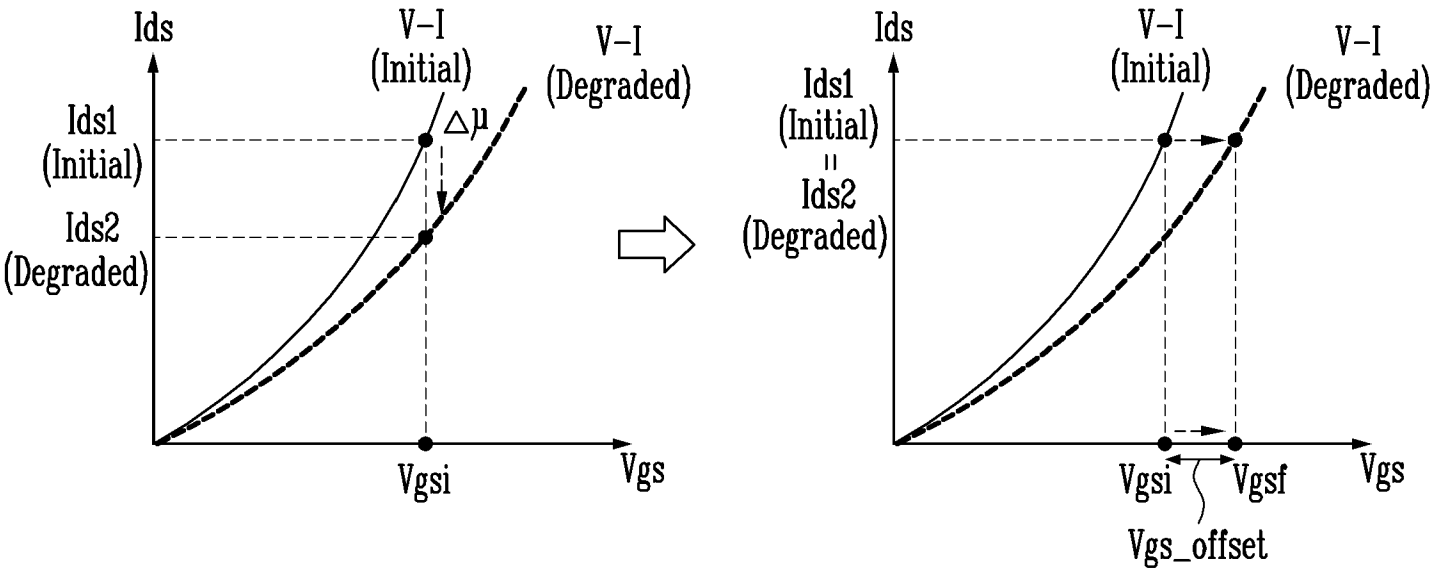
FIG. 7 is a graph for explaining a change in mobility of a driving transistor according to an embodiment of the present inventive concept.

FIG. 7 is a graph for explaining a change in mobility of a driving transistor according to an embodiment of the present inventive concept.

When the driving time of the driving transistor M1 is increased, operating characteristics may deteriorate. Therefore, deterioration of the current characteristic V-I (Degraded) of the driving transistor M1 may be occurred due to the change of the mobility of the driving transistor. As shown in the graph on the left side of FIG. 7, even when the same voltage is applied to the driving transistor M1, a current Ids2 (Degraded) of the driving transistor M1 may decrease as compared to a current Ids1 ((Initial) due to the deterioration of the mobility. Therefore, a decrease in luminance due to a decrease in current is expected, and therefore an increase in data voltage is required to maintain the same luminance as the initial characteristic.

Therefore, the second voltage Vgs_offset for compensating for the change amount of the mobility Δμ may be an additional voltage difference of the driving transistor M1 for compensating for a decrease amount of current Ids1-Ids2 of the driving transistor M1 decreased according to the change amount of the mobility Δμ.

As such, when the second voltage Vgs_offset for compensating for the change amount of the mobility Δμ is generated and added to the essential data voltage as the data voltage margin, as shown in the graph on the right side of FIG. 7, since the voltage Vgs of the driving transistor M1 becomes a voltage Vgsf after the compensation which is increased by the second voltage Vgs_offset from the voltage Vgsi before compensation, the current Ids2 having the same level as the current Ids1 may flow in the driving transistor M1. Therefore, a change in luminance can be prevented.

Figure 8:
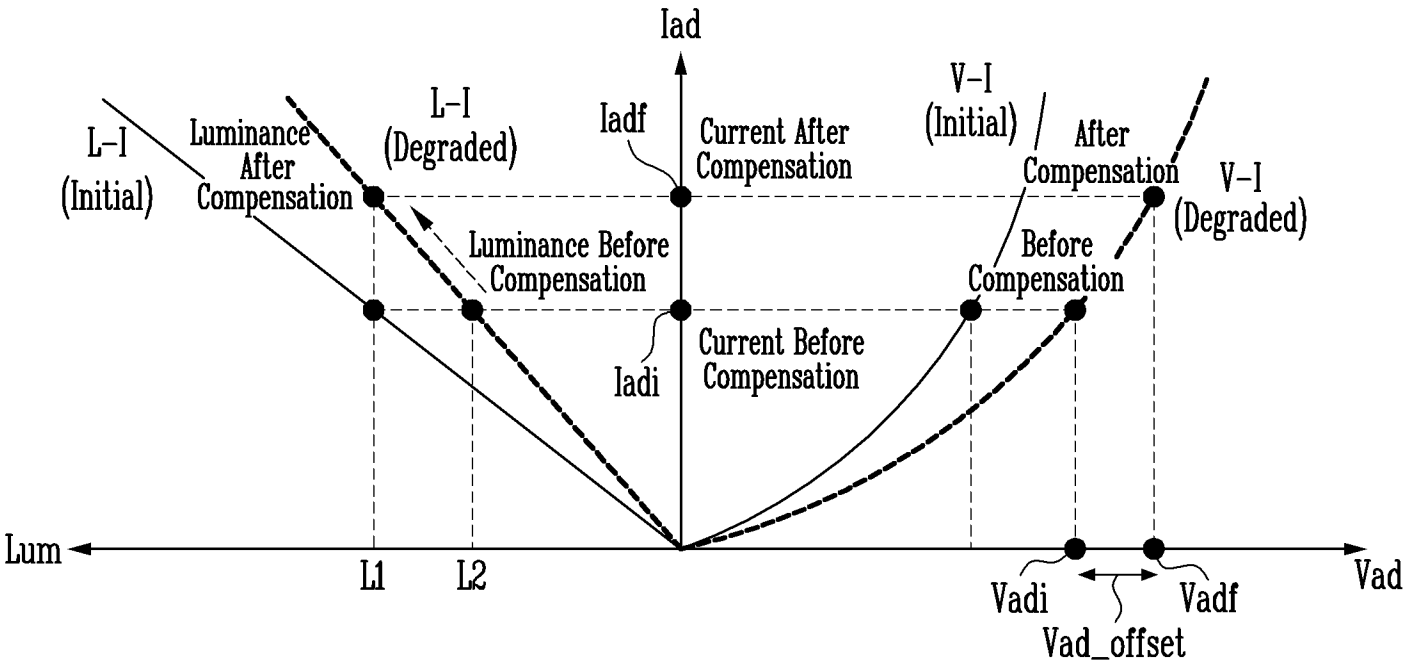
FIG. 8 is a graph for explaining a characteristic change of a light emitting element according to an embodiment of the present inventive concept.

FIG. 8 is a graph for explaining a characteristic change of a light emitting element according to an embodiment of the present inventive concept.

When the driving time of the light emitting element LD is increased, characteristics of the light emitting element LD are deteriorated, so that luminance Lum may be decreased even when the same current is flowing through the light emitting element LD. Referring to FIG. 8, in comparison with initial characteristic of the light emitting element LD, in current characteristic, the luminance Lum compared to the same current Iadi may be decreased from L1 to L2. Therefore, an increase in data voltage is required to compensate for the decrease in luminance to maintain the same luminance as the initial characteristic.

When the anode voltage Vad of the light emitting element LD is increased from a voltage Vadi before compensation to a voltage Vadf after the compensation, a current amount Iad of the light emitting element LD is increased from the current Iadi before compensation to a current Iadf after the compensation, and therefore the decrease in luminance Lum can be compensated for. That is, the third voltage Vad_offset for compensating for the change amount of the anode voltage may have the same magnitude and the opposite sign as the change amount of the anode voltage.

Figure 9:
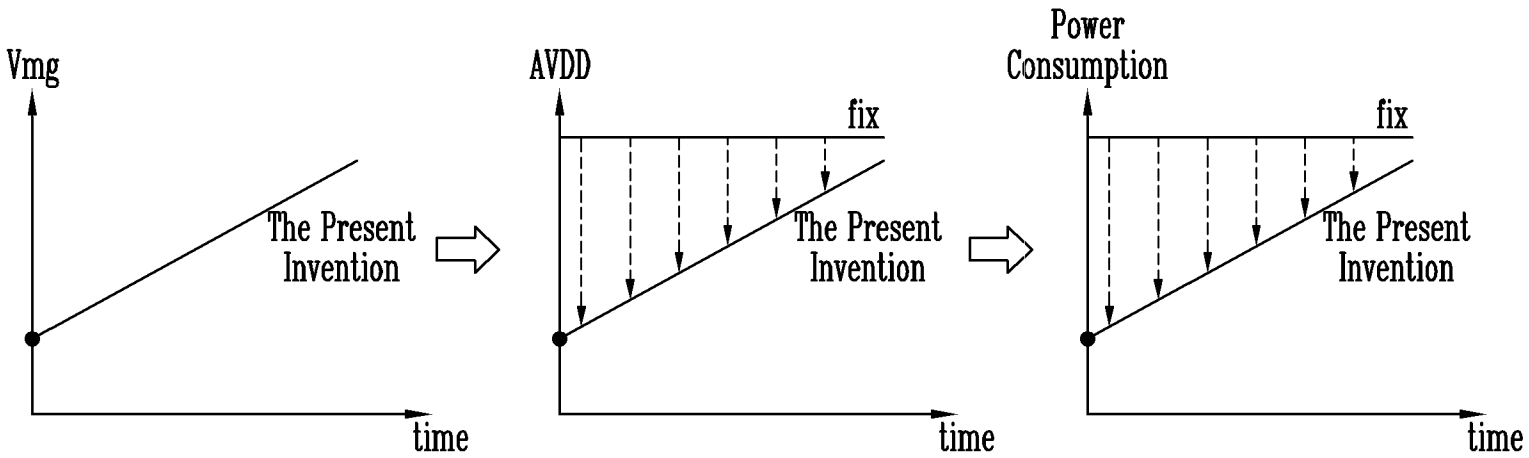
FIG. 9 is a graph for explaining an operation of a display device according to an embodiment of the present inventive concept.

FIG. 9 is a graph for explaining an operation of a display device according to an embodiment of the present inventive concept.

As described above, the display device 100 according to an embodiment of the present inventive concept may dynamically calculate the data voltage margin Vmg. In this case, the first voltage may have a positive value or a negative value according to the change in the threshold voltage, but the second voltage and the third voltage may have the positive value because they correspond to additional voltages for compensating for the decrease in luminance.

Therefore, as the driving time of the display device 100 increases, the data voltage margin Vmg may gradually increase. When the data voltage margin Vmg gradually increases, the first power source voltage AVDD may gradually increase.

Compared to a case (fix) where the first power source voltage AVDD is fixed to a high value from the beginning, the display device 100 according to the embodiments of the present inventive concept may dynamically change the first power source voltage AVDD. That is, the first power source voltage AVDD having a lower voltage level may be used for the initial driving of the display device 100, and the voltage level of the first power source voltage AVDD may be adaptively increased in response to deterioration and characteristic change caused by the use of the display device 100. Therefore, when the display device 100 according to the embodiments of the present inventive concept is applied, power consumption may be reduced.

Figure 10:
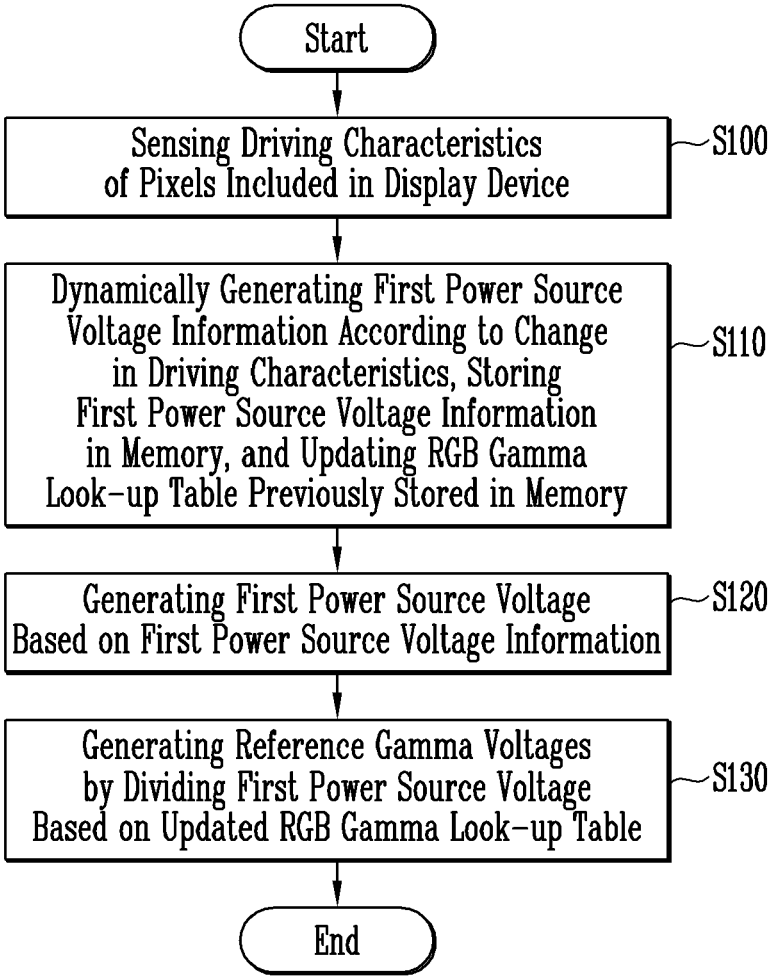
FIG. 10 is a flowchart illustrating a method for driving a display device according to an embodiment of the present inventive concept.

FIG. 10 is a flowchart illustrating a method for driving a display device according to an embodiment of the present inventive concept.

Referring to FIG. 10, a method for driving a display device according to an embodiment of the present inventive concept may include sensing driving characteristics of pixels included in the display device (S100), dynamically generating first power source voltage information according to a change in the driving characteristics, storing the first power source voltage information in a memory, and updating an RGB gamma look up table previously stored in the memory (S110), generating a first power source voltage based on the first power source voltage information (S120), and generating reference gamma voltages by dividing the first power source voltage based on the updated RGB gamma look-up table (S130).

The updating the RGB gamma look up table (S110) may include calculating a data voltage margin using a change amount of the driving characteristics, and generating the first power source voltage information based on the data voltage margin.

The driving characteristics may include mobility and threshold voltage of a driving transistor included in each of the pixels, and deterioration information of a light emitting element.

The deterioration information of the light emitting element may include an anode voltage applied to an anode of the light emitting element.

In the calculating the data voltage margin, a first voltage for compensating for a change amount of the threshold voltage, a second voltage for compensating for a change amount of the mobility, and a third voltage for compensating for a change amount of the anode voltage may be calculated.

In the calculating the data voltage margin, the data voltage margin greater than or equal to the sum of the first voltage, the second voltage, and the third voltage may be calculated.

The generating the first power source voltage information based on the data voltage margin may include determining the first power source voltage which is greater than or equal to the sum of the data voltage margin and an essential data voltage, and generating the first power source voltage information indicating the first power source voltage.

In addition, the method for driving the display device according to the embodiment of the present inventive concept should be interpreted as being applicable to the embodiments described with reference to FIGS. 1 to 9.

Since the display device and the method for driving the same according to the present inventive concept uses a voltage generated dynamically in accordance with a change in driving characteristics of the light emitting element, power consumption may be reduced.

In addition, by compensating for a change in luminance of the light emitting element according to a change in electrical characteristics, the display device may always emit light at a predetermined luminance.

The drawings referred to heretofore and the detailed description of the inventive concept described above are merely illustrative of the inventive concept. It is to be understood that the inventive concept has been disclosed for illustrative purposes only and is not intended to limit the scope of the inventive concept described in the claims. Therefore, those skilled in the art will appreciate that various modifications and equivalent embodiments are possible without departing from the scope of the inventive concept. Accordingly, the true scope of the inventive concept should be determined by the technical idea of the appended claims.

What is claimed is:

1. A display device comprising:

a plurality of pixels;

a driving characteristic compensator connected to the plurality of pixels through a plurality of receiving lines, the driving characteristic compensator sensing driving characteristics of the plurality of pixels, generating first power source voltage information according to a change in the driving characteristics, and updating an RGB gamma look-up table;

a memory connected to the driving characteristic compensator, the memory storing the first power source voltage information and the RGB gamma look-up table;

a power source manager connected to the memory, the power source manager generating a first power source voltage based on the first power source voltage information; and a gamma controller connected between the power source manager and a data driver, the gamma controller generating reference gamma voltages by dividing the first power source voltage supplied from the power source manager based on the RGB gamma look-up table, wherein the driving characteristic compensator includes:

a driving characteristic sensor connected to the plurality of receiving lines, the driving characteristic sensor sensing the driving characteristics based on currents sensed from the plurality of pixels, a driving characteristic change calculator connected to the driving characteristic sensor, the driving characteristic change calculator calculating a change amount of the drive characteristics, a data voltage margin generator connected to the driving characteristic change calculator, the data voltage margin generator receiving the change amount of the driving characteristics and generating a data voltage margin using the change amount of the driving characteristics, and a first power source voltage information generator connected to the data voltage margin generator, the first power source voltage information generator generating the first power source voltage information based on the data voltage margin.

2. The display device of claim 1, wherein the driving characteristics include mobility and threshold voltage of a driving transistor in each of the plurality of pixels, and deterioration information of a light emitting element.

3. The display device of claim 2, wherein the deterioration information of the light emitting element includes an anode voltage applied to an anode of the light emitting element.

4. The display device of claim 3, wherein the data voltage margin generator generates a first voltage for compensating for a change amount of the threshold voltage, a second voltage for compensating for a change amount of the mobility, and a third voltage for compensating for a change amount of the anode voltage.

5. The display device of claim 4, wherein the first voltage has the same magnitude as the change amount of the threshold voltage and has a sign opposite to a sign according to the change amount of the threshold voltage.

6. The display device of claim 4, wherein the second voltage is a voltage of the driving transistor that is additionally required to compensate for a decrease amount in current of the driving transistor that is reduced according to the change amount of the mobility.

7. The display device of claim 4, wherein the third voltage has the same magnitude as the change amount of the anode voltage and has a sign opposite to a sign according to the change amount of the anode voltage.

8. The display device of claim 4, wherein the data voltage margin generator generates the data voltage margin to have a value greater than or equal to the sum of the first voltage, the second voltage, and the third voltage.

9. The display device of claim 8, wherein the first power source voltage information generator generates the first power source voltage information which indicates the first power source voltage, the first power source voltage information being set for the first power source voltage to have a value greater than or equal to the sum of the data voltage margin and an essential data voltage.

10. The display device of claim 9, wherein the driving characteristic compensator further includes a look-up table updater connected to the first power source voltage information generator, the look-up table updater updating the RGB gamma look-up table by mapping data voltages and grayscale values to correspond to each other within the sum of the essential data voltage and the data voltage margin.

11. The display device of claim 1, wherein the data driver supplying data voltages generated using the reference gamma voltages to the plurality of pixels.

12. A method for driving a display device, the method comprising:

sensing driving characteristics of pixels included in the display device;

generating first power source voltage information according to a change in the driving characteristics;

storing the first power source voltage information in a memory;

updating an RGB gamma look-up table previously stored in the memory;

generating a first power source voltage based on the first power source voltage information; and generating reference gamma voltages by dividing the first power source voltage based on the updated RGB gamma look-up table, wherein the updating the RGB gamma look up table includes:

generating a data voltage margin using a change amount of the driving characteristics, and generating the first power source voltage information based on the data voltage margin.

13. The method of claim 12, wherein the driving characteristics include mobility and threshold voltage of a driving transistor in each of the pixels, and deterioration information of a light emitting element.

14. The method of claim 13, wherein the deterioration information of the light emitting element includes an anode voltage applied to an anode of the light emitting element.

15. The method of claim 14, wherein, in the generating the data voltage margin, a first voltage for compensating for a change amount of the threshold voltage, a second voltage for compensating for a change amount of the mobility, and a third voltage for compensating for a change amount of the anode voltage are generated.

16. The method of claim 15, wherein the first voltage has the same magnitude as the change amount of the threshold voltage and has a sign opposite to a sign according to the change amount of the threshold voltage.

17. The method of claim 15, wherein, in the generating the data voltage margin, the data voltage margin is set to have a value greater than or equal to the sum of the first voltage, the second voltage, and the third voltage.

18. The method of claim 17, wherein the generating the first power source voltage information based on the data voltage margin includes:

generating the first power source voltage to have a value greater than or equal to the sum of the data voltage margin and an essential data voltage; and generating the first power source voltage information indicating the first power source voltage.

* * * * *